US011332925B2

(12) United States Patent
Stender

(10) Patent No.: US 11,332,925 B2
(45) Date of Patent: May 17, 2022

(54) DRAIN ASSEMBLY INCLUDING MOISTURE TRANSPORTATION FEATURE

(71) Applicant: Moisture Management, LLC, Norwood Young America, MN (US)

(72) Inventor: Mark L. Stender, Norwood Young America, MN (US)

(73) Assignee: Moisture Management, LLC, Norwood Young America, MN (US)

( * ) Notice: Subject to any disclaimer, the term of this patent is extended or adjusted under 35 U.S.C. 154(b) by 0 days.

(21) Appl. No.: 16/426,709

(22) Filed: May 30, 2019

(65) Prior Publication Data

US 2019/0368190 A1 Dec. 5, 2019

Related U.S. Application Data

(60) Provisional application No. 62/678,351, filed on May 31, 2018.

(51) Int. Cl.

| | |
|---|---|
| ***E04B 1/70*** | (2006.01) |
| ***E04B 1/66*** | (2006.01) |
| ***E04B 2/70*** | (2006.01) |
| *E04C 2/296* | (2006.01) |

(52) U.S. Cl.

CPC ..... *E04B 1/70* (2013.01); *E04B 1/665* (2013.01); *E04B 2/707* (2013.01); *E04C 2/296* (2013.01)

(58) Field of Classification Search

CPC . E04B 1/625; E04B 1/66; E04B 1/665; E04B 2/707; E02D 19/00

See application file for complete search history.

(56) References Cited

U.S. PATENT DOCUMENTS

| | | | |
|---|---|---|---|
| 1,976,166 | A | 10/1934 | Friedberg |
| 2,066,006 | A | 12/1936 | Kellogg |
| 2,264,961 | A | 12/1941 | Ward |
| 2,324,971 | A | 7/1943 | Woodward |
| 3,096,678 | A | 7/1963 | Devine et al. |
| 3,124,847 | A | 3/1964 | Charniga, Jr. |

(Continued)

FOREIGN PATENT DOCUMENTS

GB 2169071 A 7/1986

OTHER PUBLICATIONS

Lemieux et al., "Building Envelope Design Guide—Wall Systems," WBDG Whole Building Design Guide, A program of the National Institute of Building Sciences, pp. 1-15 (Oct. 8, 2010) <http:www.bbdg.org/design/env_wall.php> Retrieved Sep. 27, 2019 web.archive.org/web/201503240232/http://www.wbdg.org/design/env_wall.php.

*Primary Examiner* — Babajide A Demuren
(74) *Attorney, Agent, or Firm* — Dicke, Billig & Czaja, PLLC

(57) ABSTRACT

Aspects of the disclosure relate to a drain assembly that incudes first and second plates, moisture inlet and outlet, a flexible sheet disposed between the first and second plates and extending between the moisture inlet and outlet. The flexible sheet is configured to wick moisture. The drain assembly is configured to position in an opening in a building envelope assembly, seal between the moisture inlet and the moisture outlet adjacent the flexible sheet, and transport moisture from the moisture inlet to the moisture outlet to transport moisture from an interior side of an envelope penetrating component positioned within the opening to an exterior side of a water separation plane.

4 Claims, 7 Drawing Sheets

(56) References Cited

U.S. PATENT DOCUMENTS

| | | | |
|---|---|---|---|
| 3,468,091 | A | 9/1969 | Gerhard |
| 3,478,639 | A | 11/1969 | Gruca |
| 3,561,177 | A | 2/1971 | Agro et al. |
| 3,568,391 | A | 3/1971 | Conway |
| 3,638,372 | A | 2/1972 | Rosenthal |
| 3,772,840 | A | 11/1973 | Hala |
| 3,895,773 | A | 7/1975 | Solo |
| 3,990,202 | A | 11/1976 | Becker |
| 4,086,840 | A | 5/1978 | Kurlander |
| RE29,804 | E | 10/1978 | Becker |
| 4,233,881 | A | 11/1980 | Carrier |
| 4,298,298 | A | 11/1981 | Pontone |
| 4,472,916 | A | 9/1984 | Krebs |
| 4,506,595 | A | 3/1985 | Roberts et al. |
| 4,580,487 | A | 4/1986 | Sosnowski |
| 4,642,012 | A | 2/1987 | Blucher et al. |
| 4,733,989 | A | 3/1988 | Harriett |
| 4,745,716 | A | 5/1988 | Kuypers |
| 4,749,306 | A | 6/1988 | Demeny et al. |
| 4,834,601 | A | 5/1989 | Schaap |
| 4,841,687 | A | 6/1989 | Navetta |
| 4,843,786 | A | 7/1989 | Walkinshaw et al. |
| 4,874,277 | A | 10/1989 | Nowak et al. |
| 4,930,959 | A | 6/1990 | Jagelid |
| 5,003,743 | A | 4/1991 | Bifano et al. |
| 5,027,572 | A | 7/1991 | Purcell et al. |
| 5,205,688 | A | 4/1993 | Sundstrom |
| 5,210,990 | A | 5/1993 | Kirk, Jr. |
| 5,218,798 | A | 6/1993 | Bentivegna et al. |
| 5,343,661 | A | 9/1994 | Sourlis |
| 5,350,265 | A | 9/1994 | Kinner |
| 5,410,852 | A | 5/1995 | Edgar et al. |
| 5,415,507 | A | 5/1995 | Janusz |
| 5,433,570 | A | 7/1995 | Koppel |
| 5,452,556 | A | 9/1995 | Taylor |
| 5,518,351 | A | 5/1996 | Peil |
| 5,598,673 | A | 2/1997 | Atkins |
| 5,692,348 | A | 12/1997 | Ambrosino |
| 5,706,804 | A | 1/1998 | Baumann et al. |
| 5,761,864 | A | 6/1998 | Nonoshita |
| 5,771,643 | A | 6/1998 | Parker |
| 5,799,454 | A | 9/1998 | Andersson et al. |
| 5,826,391 | A | 10/1998 | Underwood |
| 5,836,135 | A | 11/1998 | Hagan et al. |
| 5,860,259 | A | 1/1999 | Laska |
| 5,870,864 | A | 2/1999 | Snyder et al. |
| 5,937,600 | A | 8/1999 | Larson |
| 5,946,870 | A | 9/1999 | Bifano et al. |
| 5,953,883 | A | 9/1999 | Ojala |
| 5,988,264 | A | 11/1999 | Goldsmith |
| 6,004,088 | A | 12/1999 | Hunt |
| 6,023,892 | A | 2/2000 | Sourlis |
| 6,101,775 | A | 8/2000 | Larimore |
| 6,108,991 | A | 8/2000 | Hagan et al. |
| 6,131,353 | A | 10/2000 | Egan |
| 6,134,847 | A | 10/2000 | Bifano et al. |
| 6,148,570 | A | 11/2000 | Dinwoodie et al. |
| 6,233,890 | B1 | 5/2001 | Tonyan |
| 6,293,064 | B1 | 9/2001 | Larson |
| 6,298,620 | B1 | 10/2001 | Hatzinikolas |
| 6,385,925 | B1 | 5/2002 | Wark |
| 6,385,932 | B1 | 5/2002 | Melchiori |
| 6,410,118 | B1 | 6/2002 | Reicherts et al. |
| 6,550,212 | B2 | 4/2003 | Lubker, II |
| 6,578,331 | B1 | 6/2003 | Leslie et al. |
| 6,594,965 | B2 | 7/2003 | Coulton |
| 6,662,504 | B2 | 12/2003 | Krogstad |
| 6,742,420 | B2 | 6/2004 | Aldama |
| 6,745,531 | B1 | 6/2004 | Egan |
| 6,786,013 | B2 | 9/2004 | Coulton |
| 6,964,136 | B2 | 11/2005 | Collins et al. |
| 7,247,090 | B2 | 7/2007 | Vacek |
| 7,309,665 | B2 | 12/2007 | Qureshi et al. |
| 7,621,096 | B2 | 11/2009 | Ellis |
| 8,001,736 | B2 | 8/2011 | Goldberg et al. |
| 8,074,409 | B2 | 12/2011 | Goldberg et al. |
| 8,316,597 | B2 | 11/2012 | Goldberg et al. |
| 8,813,443 | B2 | 8/2014 | Goldberg et al. |
| 9,353,498 | B2 | 5/2016 | Goldberg et al. |
| 2002/0073628 | A1 | 6/2002 | Dextras |
| 2002/0088189 | A1 | 7/2002 | Honda |
| 2002/0108333 | A1 | 8/2002 | Clayton |
| 2002/0115367 | A1 | 8/2002 | Lolley et al. |
| 2002/0152693 | A1 | 10/2002 | Krogstad |
| 2003/0126810 | A1 | 7/2003 | Brunson et al. |
| 2003/0230035 | A1 | 12/2003 | Collins et al. |
| 2004/0003558 | A1 | 1/2004 | Collins et al. |
| 2004/0057810 | A1 | 3/2004 | Breslin et al. |
| 2004/0226238 | A1 | 11/2004 | Haapiainen |
| 2004/0255533 | A1 | 12/2004 | Koester |
| 2005/0210787 | A1 | 9/2005 | Koester |
| 2005/0246987 | A1 | 11/2005 | Hatzinikolas |
| 2006/0117687 | A1 | 6/2006 | Ehrman et al. |
| 2006/0123723 | A1 | 6/2006 | Weir et al. |
| 2006/0283102 | A1 | 12/2006 | Sourlis |
| 2007/0084139 | A1 | 4/2007 | Stender |
| 2007/0094957 | A1 | 5/2007 | Burton et al. |
| 2007/0094964 | A1 | 5/2007 | Stender |
| 2007/0183866 | A1 | 8/2007 | Gallien |
| 2007/0193151 | A1 | 8/2007 | Anderson |
| 2007/0199265 | A1 | 8/2007 | Iske et al. |
| 2007/0204541 | A1 | 9/2007 | Sade |
| 2009/0043342 | A1 | 2/2009 | Freedland |
| 2009/0183445 | A1 | 7/2009 | McPherson |
| 2010/0287861 | A1 | 11/2010 | Goldberg et al. |
| 2010/0287862 | A1 | 11/2010 | Goldberg et al. |
| 2010/0287863 | A1 | 11/2010 | Goldberg et al. |
| 2011/0250035 | A1 | 10/2011 | Goldberg et al. |
| 2012/0079789 | A1 | 4/2012 | Goldberg et al. |
| 2012/0272590 | A1 | 11/2012 | Goldberg et al. |
| 2014/0360109 | A1 | 12/2014 | Goldberg et al. |
| 2017/0204602 | A1* | 7/2017 | Collins ..... E04B 1/7046 |

* cited by examiner

DRAIN ASSEMBLY INCLUDING MOISTURE TRANSPORTATION FEATURE

CROSS-REFERENCE TO RELATED APPLICATIONS

This Non-Provisional Patent Application claims the benefit of the filing date of U.S. Provisional Patent Application Ser. No. 62/678,351, filed May 31, 2018, entitled "Building Envelope Assembly Include Moisture Transportation Feature," the entire teachings of which are incorporated herein by reference.

BACKGROUND

In some cases moisture accumulation in the insulated wall arises from wind driven water that enters the wall along a window or door seam. This form of moisture ingress can, for example, be the result of poor workmanship or from a deterioration of flashing or sealants around the window/door. In any regard, once the wall accumulates moisture it is difficult to dry the wall to a level that will not support the growth of mold and/or bacteria.

Conventional insulated wall structures are so tightly constructed/sealed, any water that is trapped in the wall (e.g., due to a breach or damage to the structure or to condensation build-up) tends to remain inside the wall. Moisture that is trapped inside a wall reduces the performance of the insulation and has the potential to feed the growth of mold and/or bacteria.

Owners, manufacturers, and remodelers of wall structures desire walls that are energy efficient, durable, and compatible with accepted construction practices.

DETAILED DESCRIPTION

Figure 1A:
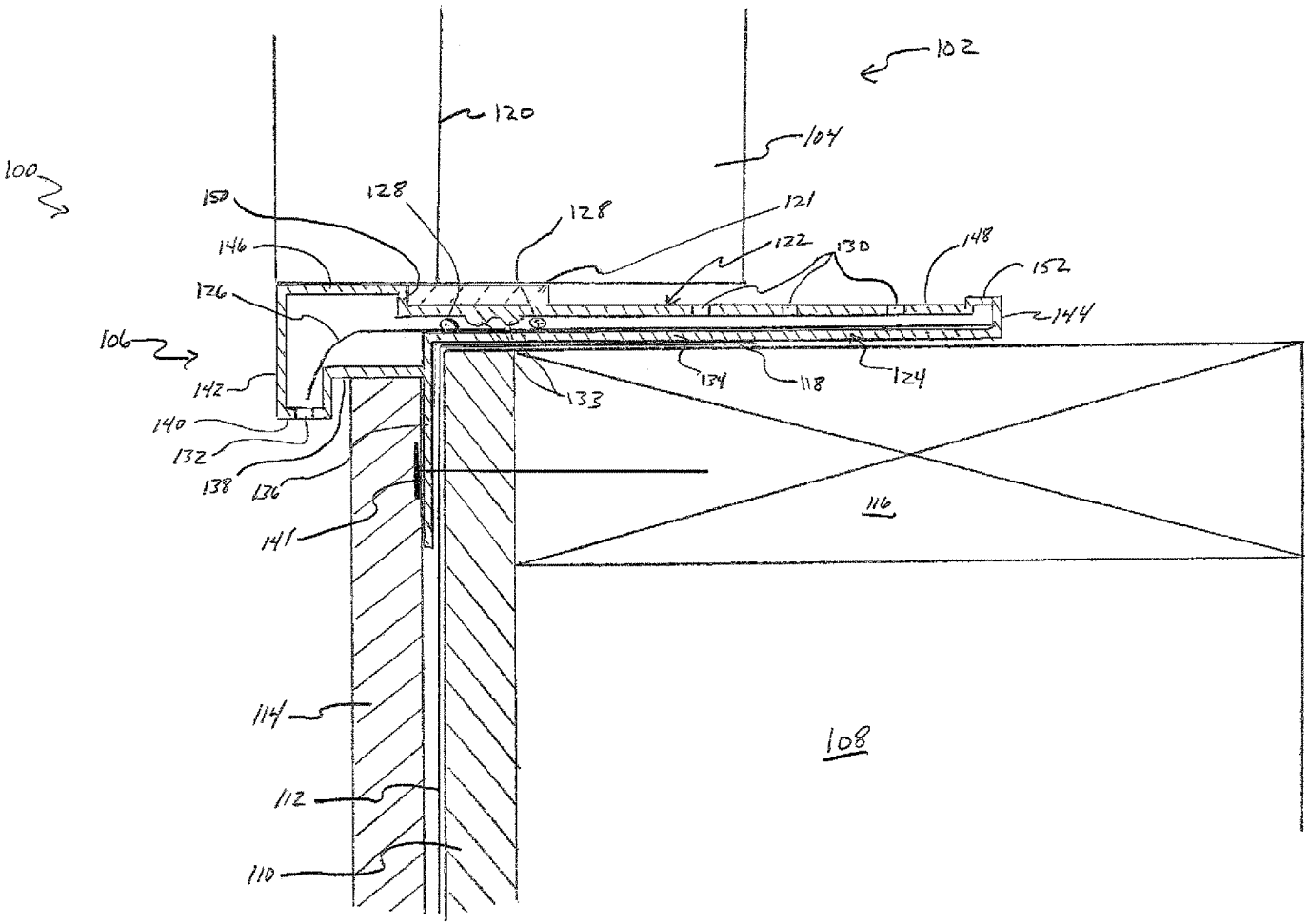
FIG. 1A is a schematic cross-sectional view of a drain assembly disposed in an envelope penetrating component opening of a building envelope assembly according to one embodiment.

In the following Detailed Description, reference is made to the accompanying drawings which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present disclosure. The following detailed description, therefore, is not to be taken in a limiting sense, and the scope of the present invention is defined by the appended claims.

It is to be understood that the features of the various exemplary embodiments described herein may be combined with each other, unless specifically noted otherwise.

As used herein, moisture includes bulk liquid water, such as rain or rain droplets, and moisture vapor, such as humidity contained in the air.

As used herein, fluid is a broad term that includes both gases and liquids.

As defined herein, building envelope assembly is a broad term which includes any assemblies which separate interior and exterior environments of a building. A building envelope assembly serves to protect the indoor environment from the elements of nature (e.g., rain, snow, etc.) and facilitate its climate control. A building envelope assembly as defined herein includes vertical assemblies, such as walls, and non-vertical assemblies, such as roofs, for example.

As used herein, a water separation plane is defined on the outboard surface of the exterior sheathing layer or exterior vapor permeable barrier, or in the case of insulated cavity walls, on the outboard side of the rigid or otherwise moisture-impervious insulation layer.

Embodiments of wall assemblies described herein apply to exterior wall assemblies, sealed and insulated exterior wall assemblies, interior wall assemblies, and/or subterranean wall assemblies. However, sealed exterior wall assemblies and subterranean wall assemblies are more susceptible to retaining moisture in the form of condensation and thus benefit directly from the embodiments described herein.

Embodiments provide a drain assembly configured to remove moisture from a building envelope assembly, and particularly for sealed and insulated wall assemblies.

Embodiments provide a flexible sheet configured for bulk transportation of moisture, which cooperates with a drain assembly. The bulk water that is collected by the flexible sheet is delivered to and removed from a lower portion of the drain assembly. In this way, the drain assembly dries the sealed building envelope assembly of both bulk water and vapor without compromising the interior/exterior liquid and vapor sealing of the building envelope assembly.

A building envelope assembly includes one or more openings formed to receive an envelope penetrating component (EPC) such as a door or a window, for example. Typically, wall assemblies are constructed in a manner that attempts to prevent moisture entrance. However, forming openings in the building envelope assembly for doors and windows unavoidably provides a pathway for moisture to enter the building envelope assembly. As described above, once moisture enters the building envelope assembly, it is difficult if not impossible to adequately dry building envelope assembly. Embodiments of drain assemblies, as described below, are configured to collect and direct moisture entering through the opening to a location outside of a water separation plane of the building envelope assembly.

FIG. 1A illustrates an embodiment of a schematic cross-sectional view of a building envelope assembly 100 having an opening 102 with an envelope penetrating component (EPC) and one example of a drain assembly 106 placed in opening 102. In general, building envelope assembly 100 includes a wall frame 108, a sheathing 110, a building paper 112, and an exterior cladding 114. Exterior cladding 114 can include any suitable cladding material such as wood siding, vinyl siding, metal panels, fiberboard, brick, stucco, etc. In one embodiment, wall frame 108 is fabricated of wood 2×4 boards installed vertically and spaced and attached to 2×6 horizontal boards at least at the top and bottom of wall frame 108. Other materials and sizes are also acceptable for wall frame 108. Insulation (not shown) is typically installed between the vertical boards forming wall frame 108. Insulation can be batt insulation or spray insulation, for example. Drain assembly 106 is placed within opening 102 formed in wall frame 108, aspects of which are described below.

As illustrated in FIG. 1A, drain assembly 106 is installed within opening 102 of building envelope assembly 100. Opening 102 is a rough opening sized to receive EPC 104 (such as a window, a door, an air conditioner, a vent, etc.). Opening 102 is formed within wall frame 108 between, for example, framing members 116 defining opening 102 within wall frame 108. Only the bottom, or sill, framing member 116 is shown in the partial cross-section. It is understood that framing members 116 are also included along the sides, or jambs, and top, or header, of opening 102. Suitable framing members 116 include wooden beams such as a 2×4 or 2×6 wood beams attached to wall frame 108.

In one embodiment, building paper 112 is an exterior vapor permeable barrier disposed between sheathing 110 and cladding 114, where the exterior vapor permeable barrier 112 allows moisture vapor to dry to the exterior side of building envelope assembly 100. In one embodiment, exterior vapor permeable barrier 112 is attached to an exterior of sheathing 110. After rough opening 102 is formed, building paper 112 (such as a house wrap material) is attached to an exterior portion of building envelope assembly 102, drain assembly 106 is positioned to overhang sheathing 110 (e.g., oriented-strand board, plywood, or other sheathing material). In one embodiment, drain assembly 106 is positioned to overhang cladding 114 (or other exterior wall cladding) that forms the exterior of building envelope assembly 102, as discussed more below.

In one embodiment, building paper 112 includes one or more layers of sixty minute grade D building paper or similar vapor permeable house wrap material stretched over and stapled to sheathing 10. In one embodiment, building paper 112 extends into opening 102. In one embodiment, a flashing 118 is installed along the bottom of opening 102 and extends about six inches up the sides of frame members 116 formed around rough opening 102. Flashing 118 is an appropriately formed sheet of flexible waterproof material. Flashing 118 can be a self-adhering, flexible material such as DuPont™ FlexWrap™ NF, for example. Other flexible waterproof materials, either solid or liquid applied, are also acceptable.

Drain assembly 106 is placed into opening 102 and attached to sill frame member 116 by any suitable attachment means, such as glue, nails, or screws. In one embodiment, EPC 104 is a window 104 placed into opening 102 and set on drain assembly 106. For ease of illustration, only a jamb portion of window 104 is illustrated positioned on drain assembly 106. Regardless, drain assembly 106 extends from an interior side of EPC 104, for example, to an exterior side of EPC 104 on a bottom side of EPC 104. EPC 104 includes a nailing fin 120 around a perimeter of EPC 104 for securing EPC 104 to wall frame 108. EPC 104 is secured to wall frame by any suitable fastening means, including but not limited to, nails or screws. In one embodiment, EPC 104 does not include nailing fin 120 along a bottom of EPC 104. In another embodiment, nailing fin 120 is removed from the bottom of EPC 104 prior to installation in opening 102.

Load bearing blocks 121, or shims 121, are positioned under EPC 104, between EPC 104 and drain assembly 106. Blocks 121 are positioned intermittently at select locations under EPC 104 as appropriate to support and level EPC 104. Load bearing blocks 121 can be any thickness to accommodate and support EPC 104 within opening 102. Load bearing blocks 121 do not need to be installed along the entire length of EPC 104 and can be installed only at select positions to adequately support EPC 104 within opening 102.

Drain assembly 106 includes a first plate 122 spaced apart from a second plate 124 with a flexible sheet 126 and at least one seal 128 disposed between plates 122, 124. First plate 122 includes holes 130 formed and positioned to enable water captured by drain 106 to seep into flexible sheet 126 for transport out of drain 106. In one embodiment, a row of holes 130 is provided in first plate 122. In other embodiments, an array of holes or an open grid or screen-like pattern of holes 130 is formed in first plate 122 to enable water collected by drain 106 to flow down to flexible sheet 126. Moisture that is wicked along flexible sheet 126 is directed out of drain assembly 106 and downward toward a drain opening 132 and outside of building envelope assembly 100.

In one embodiment, an inside surface of first plate 122 includes pressure distribution bumps 133 that are configured to distribute the load applied to drain assembly 106 by EPC 104. Bumps 133 can be formed as semi-circular protrusions or as strips, for example. Bumps 133 are distributed along a bottom surface of first plate 122 in a pattern or array that enables liquid flow within flexible sheet 126 along the full length and width of flexible sheet 126. A seal 128 can be disposed on opposing sides of bumps 133.

In one embodiment, second plate 124 includes a sill portion 134, a flange 136 extending perpendicularly away opposite first plate 122, a cladding recess 138, and a nose 140. In one embodiment, drain 106 is secured to building envelope assembly 100 with fasteners 141 extending through flange 136 and into framing member 116 and sill portion 134 positioned on flashing 118 and sill member 116. Sill frame member 116 can be tapered, or angled, downward toward the exterior to assist in drainage of drain 106 through gravity to the exterior of building envelope assembly 100. Other suitable means of angling, or sloping, drain 106 to the exterior to provide gravitational flow can be used. Flange 136 extends between sheathing 110 and cladding 114 with a top edge of cladding extending within cladding recess 138 formed between nose 140 and flange 136. Nose 140 extends below cladding recess 138 and includes drain openings 132.

First plate 122 includes a raised portion 146 and a lowered portion 148 configured to extend below a bottom jamb of EPC 104. An intermediate face 150 extends perpendicular to, and between, lower portion 148 and raised portion 146. Intermediate face 150 is sized as appropriate to accommodate blocks 121 with the top of blocks 121 generally flush with respect to raised portion 146. Load applied to blocks 121 from EPC 104 is transferred within drain assembly 106 from the first plate 122 to the second plate 124 by pressure distribution bumps 133 positioned in lower portion 148 under blocks 121 and EPC 104. Raised portion 146 can be positioned adjacent to block 121 to provide a larger cross-sectional area of drain 106 adjacent to block 121 than provided in lower portion 148. Lower portion 148 includes holes 130. Lower portion 148 terminates in ridge 152 opposite raised portion 146. Ridge 152 is positioned above lowered portion 148 to provide a back stop to fluid collected on first plate 122. A distance between a top surface of ridge 152 and lower portion 148 is suitable to accommodate a desired fluid holding capacity of drain assembly 106. First plate 122 and second plate 124 are coupled together by opposing first face 142 and second face 144. First face 142 extends between raised portion 146 and nose 140. Second face 144 extends between ridge 152 and sill portion 134.

In one embodiment, drain 106 is extruded or molded as a single integral piece into which flexible sheet 126 and seals 128 are subsequently inserted. In one embodiment, second plate 124 and first plate 122 are extruded from plastic material such as polyethylene or polyvinyl chloride (PVC). In one embodiment, drain 106 is formed of a suitable metal, such as aluminum, for example. In one embodiment, second plate includes second face 144 and first plate includes first face 142, although other configurations are acceptable. Drain 106 can be flexible, semi-rigid, or rigid.

Some window and door openings are formed to a standard size such as 36 inches wide or 48 inches wide or other standard width. In one embodiment, drain 106 is prefabricated in a molded form to fit in a standard width window and includes molded and sealed end caps formed on opposing lateral ends of drain 106. For example, for a standard width window opening of 36 inches, one embodiment of drain 106 includes integrally formed top and second plates 122, 124 extending about 36 inches between sealed end caps. In other embodiments, drain 106 is provided as an integral length of material several feet in length (on a roll, for example) and a desired length of drain 106 is selectively cut by a building contractor depending upon the window size/application.

Figure 1B:
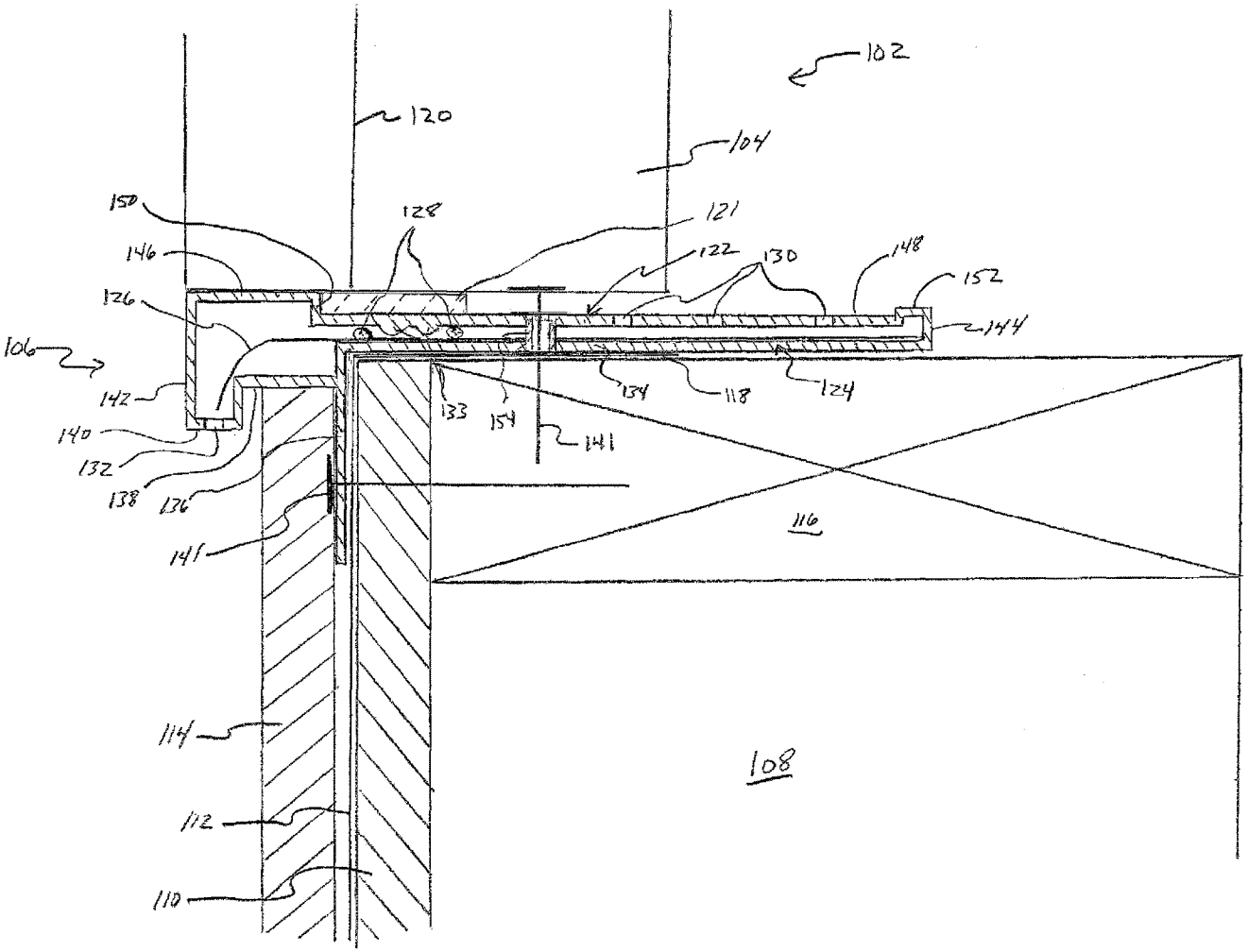
FIG. 1B is a schematic cross-sectional view of a drain assembly disposed in an envelope penetrating component opening of a building envelope assembly according to one embodiment.

With reference to the embodiment of FIG. 1B, EPC 104 is a door 104 placed into opening 102 and set on drain assembly 106. For ease of illustration, only a jamb portion of door 104 is illustrated positioned on drain assembly 106. Regardless, drain assembly 106 extends from an interior side of EPC 104, for example, to the exterior side of EPC 104 on the bottom side of EPC 104. EPC 104 is secured to wall frame 108 by any suitable fastening means, including but not limited to, nails or screws. Door 104 does not include nailing fin 120 along a bottom of EPC 104. In one embodiment, drain assembly 106 includes bushings 154 positioned to extend between first plate 122 and second plate 124. Bushings 154 are open at top and bottom ends and sized and shaped to accept a fastener 141, such as a screw or nail, extending through bushing 154 to secure a bottom threshold of door 104 to sill 116. In one embodiment, a block 121 placed over or on opposing sides of bushing 154 to assist in supporting and transferring the load of EPC 104 to sill 116. Bushings 154 are fluidly sealed to first plate 122 and second plate 124 such that fluid within drain assembly 106 does not traverse out of drain assembly 106 through openings formed by bushings 154. Bushings 154 can be included in drain assembly 106 in a pattern, for example, occurring 16 inches on center along the length of drain assembly 106.

With continued reference to FIGS. 1A and 1B, in one embodiment, seal 128 is disposed between flexible sheet 126 and first plate 122. Seals 128 extend within drain assembly 106 directly below load bearing block 121. Seals 128 and sheet 126, contribute to the effective transfer of loads within building envelope assembly 100. Seals 128 prevent or limit ingress of bulk water into drain 106 from the exterior. In one embodiment, drain assembly 106 includes two seals 128. This double seal provides a hydrodynamic seal to prevent wind-driven rain from entering under a window 104 placed into opening 102. In addition, seal 128 enables liquid to be transported under/through seal 128 from drain 106 to drain opening 138. Drain 106 is configured to drain moisture to the exterior of building envelope assembly 100 while preventing ingress of wind-driven rain or other bulk water.

In one embodiment, drain 106 is provided as a sealed system and includes at least one seal 128 coupled to flexible sheet 126. Seal 128 is provided as a fluid seal that prevents the pressure driven flow of moist interior air and/or moist exterior air toward wall frame 108 and to prevent the diffusion of water vapor across sheet 126 (thus preventing the unchecked movement of humid air into building envelope assembly 100). Seal 128 limits the exchange of humid air through building envelope assembly 100 to enable sheet 126 to efficiently collect and direct moisture away from wall frame 108. In one embodiment, seal 128 is configured as a vapor seal that enables capillary flow along a structure (for example fibers) coupled to sheet 126. In one embodiment, seals 128 are silicon.

In one embodiment, sheet 126 includes a capillary structure that is configured to wick moisture. In one embodiment, sheet 126 is configured to wick moisture by capillary action and are formed of a hydrophilic fiber mat. In one embodiment, the hydrophilic fiber mat is a woven fiber mat of rayon fibers. In one embodiment, the hydrophilic fiber mat is a non-woven fiber mat formed of a random array of mutually-bonded rayon staple fibers. In other embodiments, the hydrophilic fiber web is formed on non-woven fiber forming equipment to have a preferential machine direction that configures the flow of moisture out of drain 106. Moisture that enters opening 102 is collected by drain 106, directed through holes 130 formed in first plate 122 into drain 106 to flexible sheet 126, and subsequently directed along sheet 126 to drain opening 138 and, in one embodiment, exterior of cladding 114.

Sheet 126 cooperates with drain 106 to collect and transport moisture that enters into opening 102 away from wall frame 108. Bulk moisture is transported within drain 106 by sheet 126. Condensation or bulk water entering building envelope assembly 100 from either the interior or the exterior is removed from building envelope assembly 100 by drain 106, which minimizes or eliminates the potential for mold and/or rot to be produced by moisture that is trapped within building envelope assembly 100.

Figure 1C:
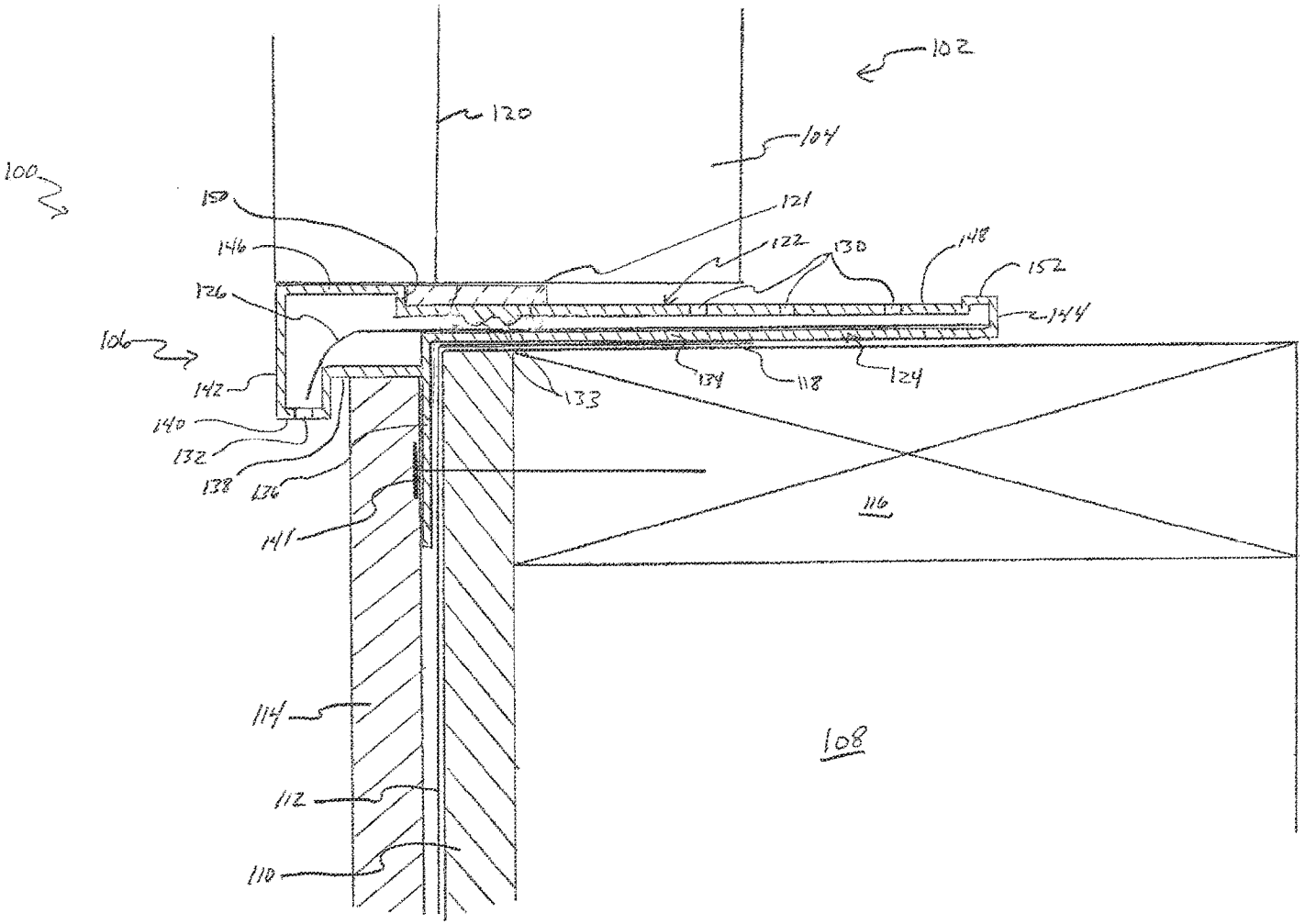
FIG. 1C is a schematic cross-sectional view of a drain assembly disposed in an envelope penetrating component opening of a building envelope assembly according to one embodiment.

FIG. 1C illustrates an embodiment of a schematic cross-sectional view of a building envelope assembly 100 having an opening 102 with an envelope penetrating component (EPC) and one example of a drain assembly 106 placed in opening 102. In general, building envelope assembly 100 includes a wall frame 108, a sheathing 110, a building paper 112, and an exterior cladding 114. Exterior cladding 114 can include any suitable cladding material such as wood siding, vinyl siding, metal panels, fiberboard, brick, stucco, etc. In one embodiment, wall frame 108 is fabricated of wood 2×4 boards installed vertically and spaced and attached to 2×6 horizontal boards at least at the top and bottom of wall frame 108. Other materials and sizes are also acceptable for wall frame 108. Insulation (not shown) is typically installed between the vertical boards forming wall frame 108. Insulation can be batt insulation or spray insulation, for example. Drain assembly 106 is placed within opening 102 formed in wall frame 108, aspects of which are described below.

As illustrated in FIG. 1C, drain assembly 106 is installed within opening 102 of building envelope assembly 100.

Opening 102 is a rough opening sized to receive EPC 104 (such as a window, a door, an air conditioner, a vent, etc.). Opening 102 is formed within wall frame 108 between, for example, framing members 116 defining opening 102 within wall frame 108. Only the bottom, or sill, framing member 116 is shown in the partial cross-section. It is understood that framing members 116 are also included along the sides, or jambs, and top, or header, of opening 102. Suitable framing members 116 include wooden beams such as a 2×4 or 2×6 wood beams attached to wall frame 108.

In one embodiment, building paper 112 is an exterior vapor permeable barrier disposed between sheathing 110 and cladding 114, where the exterior vapor permeable barrier 112 allows moisture vapor to dry to the exterior side of building envelope assembly 100. In one embodiment, exterior vapor permeable barrier 112 is attached to an exterior of sheathing 110. After rough opening 102 is formed, building paper 112 (such as a house wrap material) is attached to an exterior portion of building envelope assembly 102, drain assembly 106 is positioned to overhang sheathing 110 (e.g., oriented-strand board, plywood, or other sheathing material). In one embodiment, drain assembly 106 is positioned to overhang cladding 114 (or other exterior wall cladding) that forms the exterior of building envelope assembly 102, as discussed more below.

In one embodiment, building paper 112 includes one or more layers of sixty minute grade D building paper or similar vapor permeable house wrap material stretched over and stapled to sheathing 10. In one embodiment, building paper 112 extends into opening 102. In one embodiment, a flashing 118 is installed along the bottom of opening 102 and extends about six inches up the sides of frame members 116 formed around rough opening 102. Flashing 118 is an appropriately formed sheet of flexible waterproof material. Flashing 118 can be a self-adhering, flexible material such as DuPont™ FlexWrap™ NF, for example. Other flexible waterproof materials, either solid or liquid applied, are also acceptable.

Drain assembly 106 is placed into opening 102 and attached to sill frame member 116 by any suitable attachment means, such as glue, nails, or screws. In one embodiment, EPC 104 is a window 104 placed into opening 102 and set on drain assembly 106. For ease of illustration, only a jamb portion of window 104 is illustrated positioned on drain assembly 106. Regardless, drain assembly 106 extends from an interior side of EPC 104, for example, to an exterior side of EPC 104 on a bottom side of EPC 104. EPC 104 includes a nailing fin 120 around a perimeter of EPC 104 for securing EPC 104 to wall frame 108. EPC 104 is secured to wall frame by any suitable fastening means, including but not limited to, nails or screws. In one embodiment, EPC 104 does not include nailing fin 120 along a bottom of EPC 104. In another embodiment, nailing fin 120 is removed from the bottom of EPC 104 prior to installation in opening 102.

Load bearing blocks 121, or shims 121, are positioned under EPC 104, between EPC 104 and drain assembly 106. Blocks 121 are positioned intermittently at select locations under EPC 104 as appropriate to support and level EPC 104. Load bearing blocks 121 can be any thickness to accommodate and support EPC 104 within opening 102. Load bearing blocks 121 do not need to be installed along the entire length of EPC 104 and can be installed only at select positions to adequately support EPC 104 within opening 102.

With continued reference to FIG. 1C, drain assembly 106 includes a first plate 122 spaced apart from a second plate 124 with a flexible sheet 126 disposed between plates 122, 124. First plate 122 includes holes 130 formed and positioned to enable water captured by drain 106 to seep into flexible sheet 126 for transport out of drain 106. In one embodiment, a row of holes 130 is provided in first plate 122. In other embodiments, an array of holes or an open grid or screen-like pattern of holes 130 is formed in first plate 122 to enable water collected by drain 106 to flow down to flexible sheet 126. Moisture that is wicked along flexible sheet 126 is directed out of drain assembly 106 and downward toward a drain opening 132 and outside of building envelope assembly 100.

In one embodiment, an inside surface of first plate 122 includes pressure distribution bumps 133 that are configured to distribute the load applied to drain assembly 106 by EPC 104. Bumps 133 can be formed as semi-circular protrusions or as strips, for example. Bumps 133 are distributed along a bottom surface of first plate 122 in a pattern or array that enables liquid flow within flexible sheet 126 along the full length and width of flexible sheet 126.

In one embodiment, second plate 124 includes a sill portion 134, a flange 136 extending perpendicularly away opposite first plate 122, a cladding recess 138, and a nose 140. In one embodiment, drain 106 is secured to building envelope assembly 100 with fasteners 141 extending through flange 136 and into framing member 116 and sill portion 134 positioned on flashing 118 and sill member 116. Sill frame member 116 can be tapered, or angled, downward toward the exterior to assist in drainage of drain 106 through gravity to the exterior of building envelope assembly 100. Other suitable means of angling, or sloping, drain 106 to the exterior to provide gravitational flow can be used. Flange 136 extends between sheathing 110 and cladding 114 with a top edge of cladding extending within cladding recess 138 formed between nose 140 and flange 136. Nose 140 extends below cladding recess 138 and includes drain openings 132.

First plate 122 includes a raised portion 146 and a lowered portion 148 configured to extend below a bottom jamb of EPC 104. An intermediate face 150 extends perpendicular to, and between, lower portion 148 and raised portion 146. Intermediate face 150 is sized as appropriate to accommodate blocks 121 with the top of blocks 121 generally flush with respect to raised portion 146. Load applied to blocks 121 from EPC 104 is transferred within drain assembly 106 from the first plate 122 to the second plate 124 by pressure distribution bumps 133 positioned in lower portion 148 under blocks 121 and EPC 104. Raised portion 146 can be positioned adjacent to block 121 to provide a larger cross-sectional area of drain 106 adjacent to block 121 than provided in lower portion 148. Lower portion 148 includes holes 130. Lower portion 148 terminates in ridge 152 opposite raised portion 146. Ridge 152 is positioned above lowered portion 148 to provide a back stop to fluid collected on first plate 122. A distance between a top surface of ridge 152 and lower portion 148 is suitable to accommodate a desired fluid holding capacity of drain assembly 106. First plate 122 and second plate 124 are coupled together by opposing first face 142 and second face 144. First face 142 extends between raised portion 146 and nose 140. Second face 144 extends between ridge 152 and sill portion 134.

In one embodiment, drain 106 is extruded or molded as a single integral piece into which flexible sheet 126 is subsequently inserted. In one embodiment, second plate 124 and first plate 122 are extruded from plastic material such as polyethylene or polyvinyl chloride (PVC). In one embodiment, drain 106 is formed of a suitable metal, such as aluminum, for example. In one embodiment, second plate includes second face 144 and first plate includes first face 142, although other configurations are acceptable. Drain 106 can be flexible, semi-rigid, or rigid.

Some window and door openings are formed to a standard size such as 36 inches wide or 48 inches wide or other standard width. In one embodiment, drain 106 is prefabricated in a molded form to fit in a standard width window and includes molded and sealed end caps formed on opposing lateral ends of drain 106. For example, for a standard width window opening of 36 inches, one embodiment of drain 106 includes integrally formed top and second plates 122, 124 extending about 36 inches between sealed end caps. In other embodiments, drain 106 is provided as an integral length of material several feet in length (on a roll, for example) and a desired length of drain 106 is selectively cut by a building contractor depending upon the window size/application.

With continued reference to FIG. 1C, drain assembly 106 is configured to position in opening 102 in building envelope assembly 100. Drain assembly 106 is configured to seal between the moisture inlet and the moisture outlet adjacent flexible sheet 126. Drain assembly 106 is configured to transport moisture from the moisture inlet to the moisture outlet to transport moisture from an interior side of EPC 104 positioned within opening 102 to an exterior side of a water separation plane.

With continued reference to FIG. 1C, in one embodiment, flexible sheet 126 contributes to the effective transfer of loads within building envelope assembly 100. Drain assembly 106 is configured to prevent or limit ingress of bulk water into drain 106 from the exterior. In one embodiment, drain assembly 106 is configured to provide a hydrodynamic seal to prevent wind-driven rain from entering under a window 104 placed into opening 102. In addition, drain assembly 106 is configured to enable liquid to be transported from drain assembly 106 to drain opening 138. Drain assembly 106 is configured to drain moisture to the exterior of building envelope assembly 100 while preventing ingress of wind-driven rain or other bulk water.

With continued reference to FIG. 1C, in one embodiment, drain assembly 106 is provided as a sealed system and includes flexible sheet 126. Drain assembly 106 is configured to prevent the pressure driven flow of moist interior air and/or moist exterior air toward wall frame 108 and to prevent the diffusion of water vapor across sheet 126 (thus preventing the unchecked movement of humid air into building envelope assembly 100). Drain assembly 106 is configured to limit the exchange of humid air through building envelope assembly 100 to enable sheet 126 to efficiently collect and direct moisture away from wall frame 108. In one embodiment, drain assembly 106 is configured as a vapor seal that enables capillary flow along a structure (for example fibers) coupled to sheet 126.

With continued reference to FIG. 1C, in one embodiment, flexible sheet 126 includes a capillary structure that is configured to wick moisture. In one embodiment, sheet 126 is configured to wick moisture by capillary action and are formed of a hydrophilic fiber mat. In one embodiment, the hydrophilic fiber mat is a woven fiber mat of rayon fibers. In one embodiment, the hydrophilic fiber mat is a non-woven fiber mat formed of a random array of mutually-bonded rayon staple fibers. In other embodiments, the hydrophilic fiber web is formed on non-woven fiber forming equipment to have a preferential machine direction that configures the flow of moisture out of drain assembly 106. Moisture that enters opening 102 is collected by drain assembly 106, directed through holes 130 formed in first plate 122 into drain assembly 106 to flexible sheet 126, and subsequently directed along sheet 126 to drain opening 138 and, in one embodiment, exterior of cladding 114.

With continued reference to FIG. 1C, in one embodiment, flexible sheet 126 cooperates with drain assembly 106 to collect and transport moisture that enters into opening 102 away from wall frame 108. Bulk moisture is transported within drain assembly 106 by sheet 126. Condensation or bulk water entering building envelope assembly 100 from either the interior or the exterior is removed from building envelope assembly 100 by drain assembly 106, which minimizes or eliminates the potential for mold and/or rot to be produced by moisture that is trapped within building envelope assembly 100.

Figure 2:
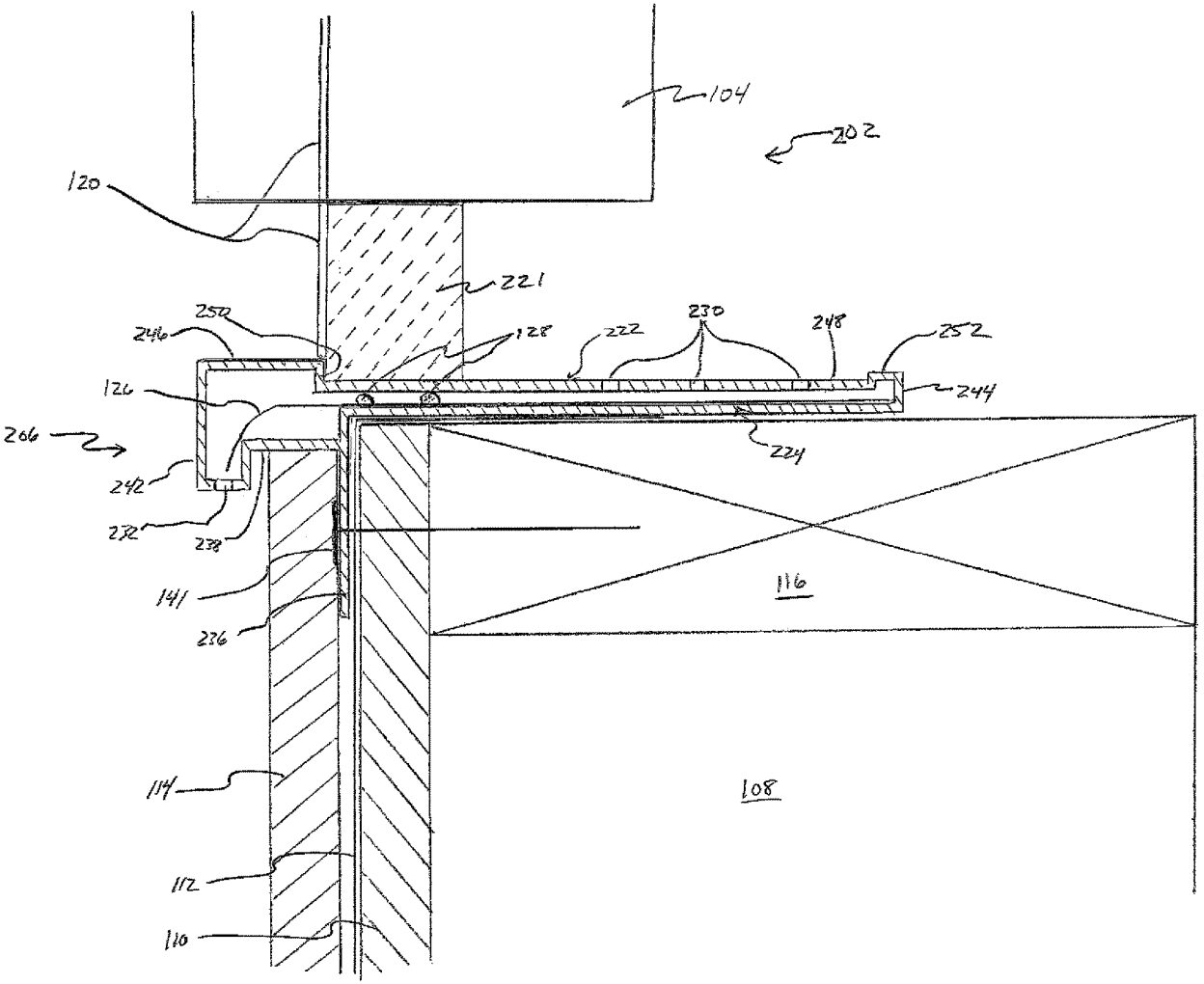
FIG. 2 is a schematic cross-sectional view of a drain assembly disposed in an envelope penetrating component opening of a building envelope assembly according to one embodiment.

FIG. 2 illustrates an embodiment of a drain assembly 206 within an opening 202 of building envelope assembly 100. Aspects of drain assembly 206 are similar to drain assembly 106. In this embodiment, EPC 104 or window 104 retains nailing fin 120 on the bottom side. To accommodate nailing fin 120 on the bottom of EPC 104, a thickness of a block 221 is increased from that of block 121 included in FIG. 1A. Block 221 can be available in various heights to accommodate the height of nailing fin 120 of a variety of EPCs 104. Accordingly, the size of opening 202 is also correspondingly increased to accommodate the height of nailing fin 120 on the bottom edge of window 104. In one embodiment, load block 221 is positioned along an inside face of nailing fin 120 and against an intermediate face 250 of a first plate 222. Nailing fin 120 is attached to block 221 with an adhesive, fasteners, or other suitable attachment means. A raised portion 246 is extended inward from a first face 242 and a lowered portion 248 is shortened to position intermediate face 250 immediately adjacent nailing fin 120. Drain assembly 206 can be suitable for any EPC 104 by accommodating nailing fin 120.

Figure 3:
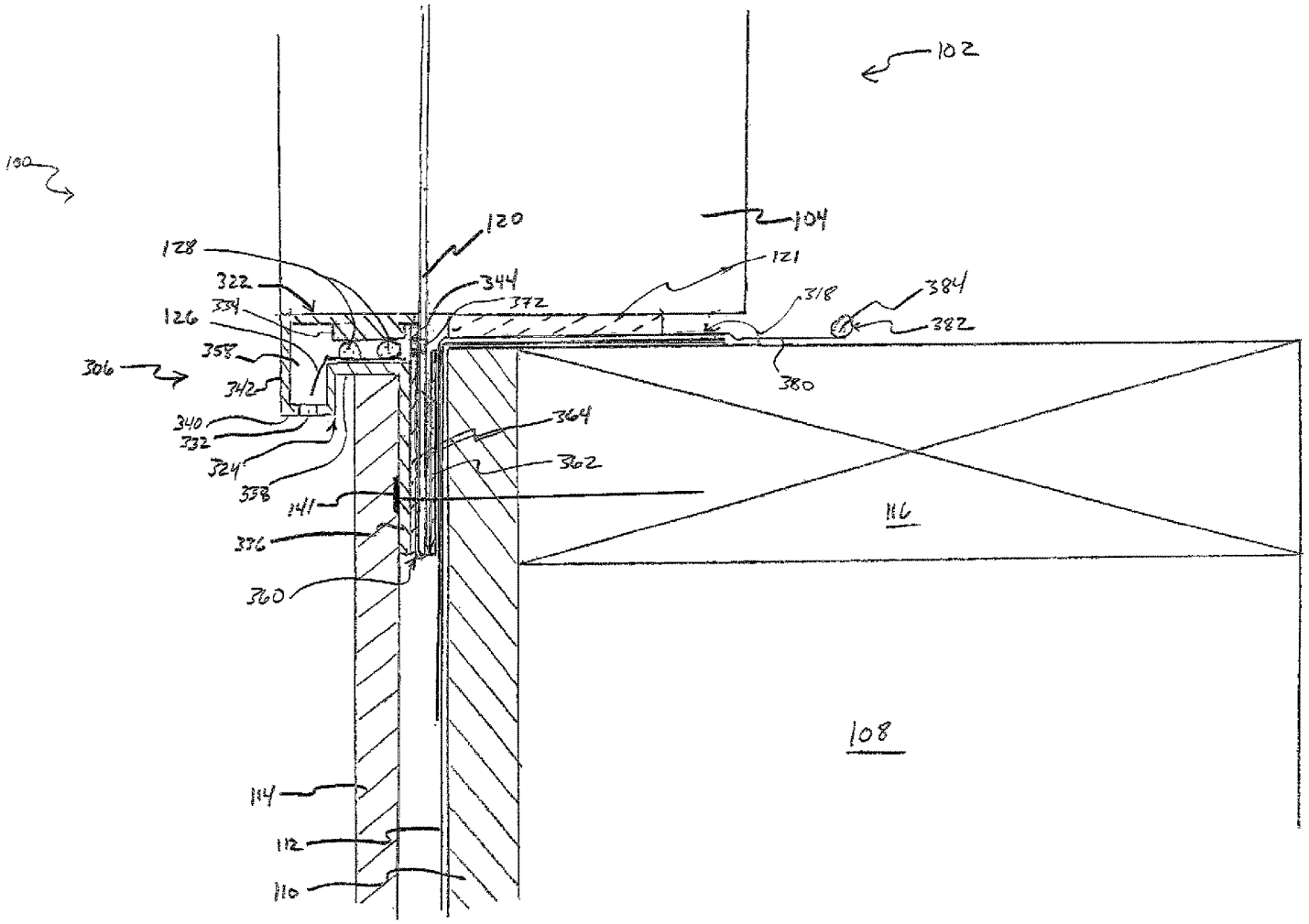
FIG. 3 is a schematic cross-sectional view of a moisture drain disposed in an envelope penetrating component opening of a building envelope assembly according to one embodiment.

FIG. 3 illustrates another embodiment of a drain assembly 306 in building envelope assembly 100 in accordance with aspects of the present disclosure. Drain assembly 306 is positioned between sheathing 110 and exterior of cladding 114. A gasket 360 is included with drain assembly 306.

Drain 306 includes a first plate 322 spaced apart from a second plate 324 with a flexible sheet 126 and seals 128 disposed between plates 322, 324. Second plate 324 includes a flange 336 extending perpendicularly away opposite first plate 322, a cladding recess 338, and a nose 340. Nose 340 extends below cladding recess 338 and includes drain openings 332. In one embodiment, drain 306 includes a first face 342 that is closed and a second face 344 that is open. In another embodiment, second face 344 includes select openings sized and positioned to allow fluid to flow into a drainage cavity 358 defined by the interior of drain 306.

Flexible sheet 126 and seals 128 can be pre-assembled into drain 306. In one embodiment, first plate 322 includes a seal projection 334 extending toward second plate 324; seals 128 are positioned between seal projection 334 and second plate 324. Seal projection 334 can be used to maintain a tight fit of seals 128 between first plate 322 and second plate 324 while maintaining an extended cross-sectional area of drain cavity 358. The top of blocks 121 are generally flush with first plate 322.

Gasket 360 is a flexible gasket configured to wrap around and attach to window fin 120. In one embodiment, gasket 360 is a double-sided adhesive foam tape. Gasket 360 includes a gasket foam 362, an adhesive backed film 364. In one embodiment, adhesive backed film 364 is a polypropylene film with a butyl rubber adhesive backing such as those commonly used in building flashing tape. Adhesive backed film 364 has a first major side and a second major side (not shown). In one embodiment, a removable paper backing (not shown) is included on the second major side of adhesive backed film 364. The first major side 368 is applied to flange 336 and extends at least to second face 344 and, in some embodiment, extends over a portion of first plate 322. In one embodiment, gasket 360 extends along at least a portion of first plate 322 to secure gasket 360 to first plate 322 across second face 344. First plate 322 is positioned against a bottom surface of window 304 and the second major side of adhesive backed film 364 is secured along nailing fin 320. The paper backing is removed as appropriate prior to securing the second major side to an exterior surface of nailing fin 320. Gasket 360 is wrapped around a bottom edge of nailing fin 320 and the second major side of adhesive back film 364 is secured to an interior surface of nailing fin 320. Gasket foam 362 extends along the interior surface of nailing fin 320 to terminate adjacent to the bottom of window 304. In one embodiment, gasket foam 362 can also be included along the exterior surface of nailing fin 320 (not shown).

Drain assembly 306 can be attached to window 104 by adhesive backed film 364 of gasket 360 and/or other adhesive or appropriate fastener. Holes 372 are formed and positioned through gasket 360 and nailing fin 320 at openings in second face 344 to enable water captured by a flashing 318 to drain 306 and seep into flexible sheet 126 for transport out of drain 306. Gasket 360 provides a seal on either side nailing fin 320 at holes 372. Holes 372 can be pre-formed in some or all of gasket 360 and window fin 120, prior to assembly together, or after assembly of drain assembly 306 to window 04 and prior to installation of window 104 into building envelope assembly 100. In one embodiment, drain assembly 306 is factory assembled to window 104. Hole 372 spacing along the length of drain assembly 306 can be predetermined or determined at the installation site. Moisture that is wicked along flexible sheet 126 is directed out of drain assembly 306 and downward toward drain opening 332 and outside of building envelope assembly 100.

In one embodiment, flashing 318 is installed along a bottom of opening 102 and extends about six inches up the sides of frame members 116 formed around rough opening 102. Flashing 318 includes a sheet of flexible waterproof membrane 380 similar to that of flashing 118. Membrane 380 can be a self-adhering, flexible material such as DuPont™ FlexWrap™ NF, for example, although other flexible flashing materials are also acceptable. Flashing 318 also includes a back dam 382. Back dam 382 can include a seal strip 384 attached to flexible membrane 380. In one embodiment, flexible membrane 380 is wrapped around seal strip 384 and a terminal end of flexible membrane 380 is sealed or adhered to a planar portion of flexible membrane 380 to form back dam 380. In another embodiment, seal strip 384 is thermos-mechanically attached to flexible membrane 380. Adhesives or other fastening methods are also acceptable. Back dam 384 is positioned interior of window 104 to provide a back stop to fluid collected under window 104. Sill frame member 116 can be tapered, or angled, downward toward the exterior to assist in drainage along flashing 318 through gravity to the drain 306 and exterior of building envelope assembly 100. Other suitable means of angling, or sloping, to the exterior to provide gravitational flow can be used.

Drain assembly 306 is placed into rough opening 102. Blocks 121 are positioned intermittently at select locations under window 104, between sill frame member 116 and window 104 as appropriate to support, level, and provide drainage space between sill frame member 116 and the bottom of window 104. Window 104 is secured into opening 102 by any suitable fastening means. Drain assembly 306 extends only on an exterior side of window 104. When installed, flange 336, window fin 320, and gasket 360 each extend between sheathing 110 and cladding 114. In one embodiment, drain 306 is secured to building envelope assembly 100 with fasteners 141 extending through flange 336 and into framing member 116 with a top edge of cladding 114 extending within recess 338.

Figure 4:
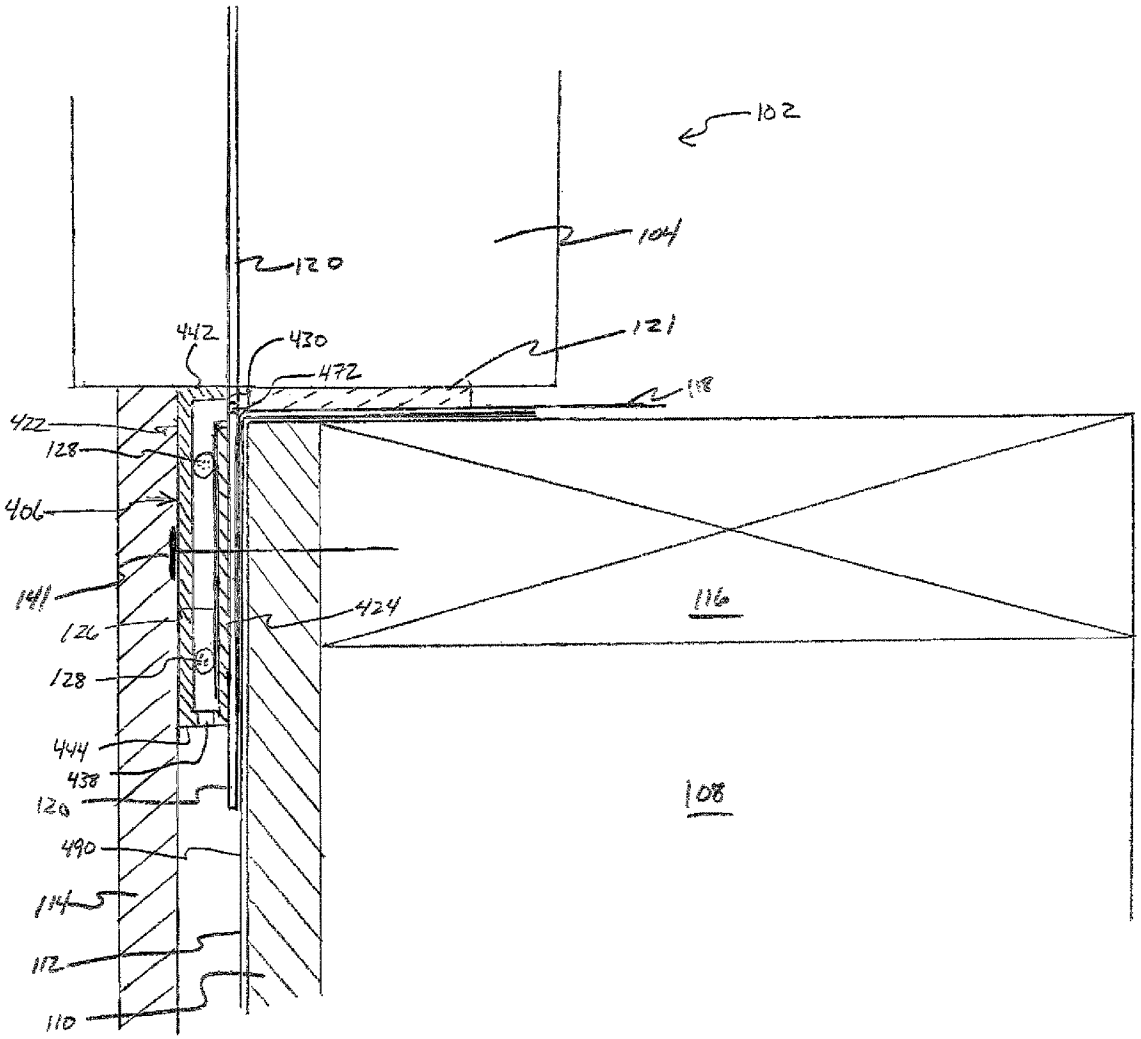
FIG. 4 is a schematic cross-sectional view of a moisture drain disposed in an envelope penetrating component of a building envelope assembly according to one embodiment.

FIG. 4 illustrates an embodiment of a drain assembly 406. Drain assembly 406 is generally rectangular and includes first plate 422 spaced apart and parallel to a second plate 424, and a first face 442 and an opposing second face 444 connecting the top and second plates 422, 424. An inlet 430 or inlets 430 are included in second plate 424 adjacent first face 442 to provide an opening(s) for fluid to flow into drain assembly 406. Drain openings 432 are included in second face 444 to provide outlets for the fluid from drain assembly 406. Flexible sheet 126 and seals 128 are assembled within drain assembly 406 with flexible sheet 126 extending from inlet(s) 430 to drain opening 432.

As illustrated in FIG. 4, drain assembly 406 is assembled to an exterior surface of nailing fin 120 of window 104 adjacent the bottom of window 104. Drain assembly 406 can be attached to nailing fin 120 by adhesives or other appropriate means to secure and seal second plate 424 of drain assembly 406 to nailing fin 120. In one embodiment, fasteners 141 extend through drain assembly 406, nailing fin 120, building paper 112, sheathing 110 and into frame member 116 to secure window 104 within opening 102 and secure drain assembly 406 to nailing fin 420. In one embodiment, one seal 128 is positioned below fasteners 141 and one seal 128 is positioned above fasteners 141. Holes 472 are formed in nailing fin 120 and aligned with inlets 430. In one embodiment, drain assembly 406 is factory assembled to window 104. Inlets 430 and holes 472 can be pre-formed in drain assembly 406 and window fin 420, respectively, prior to assembly together, or after assembly of drain assembly 406 to the window 104 and prior to installation of window 104 into building envelope assembly 100. Inlet 430 and hole 472 spacing along the length of drain assembly 406 can be predetermined or determined at the installation site and can be consistent along the length or in a select pattern. Moisture that is wicked along flexible sheet 126 is directed out of drain assembly 406 and downward toward drain opening 432 exterior of a water separation plane 490 of building envelope assembly 100.

Figure 5:
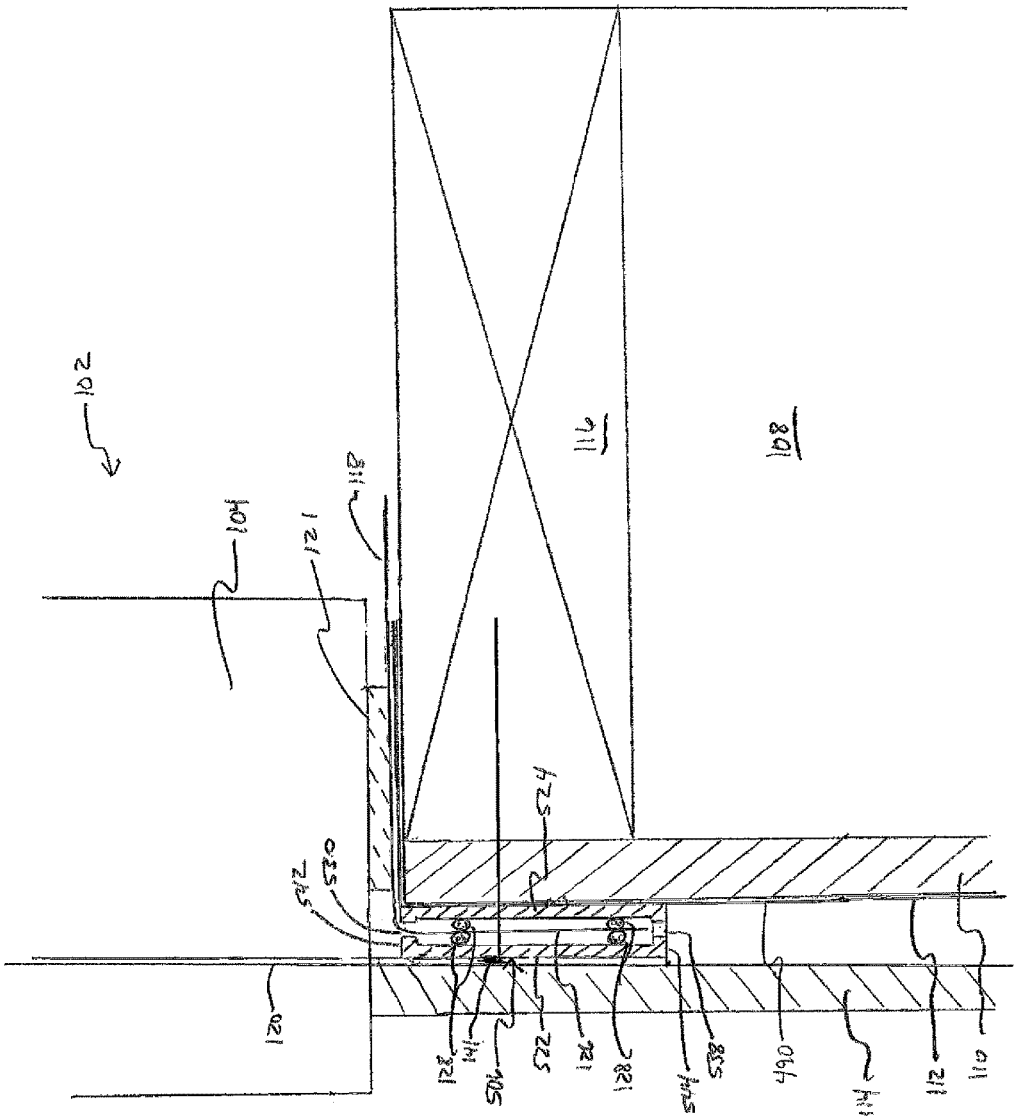
FIG. 5 is a schematic cross-sectional view of a moisture drain disposed in an envelope penetrating component of a building envelope assembly according to one embodiment.

FIG. 5 illustrates an embodiment of a drain assembly 506. Drain assembly 506 is generally rectangular and includes first plate 522 spaced apart and parallel to a second plate 524, and a first face 542 and an opposing second face 544 connecting the top and second plates 522, 524. An inlet 530 or inlets 530 are included in first face 542 adjacent first face 542 to provide an opening(s) for fluid to flow into drain assembly 406. Drain openings 532 are included in second face 544 to provide outlets for the fluid from drain assembly 506. Flexible sheet 126 and seals 128 are assembled within drain assembly 506 with flexible sheet 126 extending exterior of and beyond inlet(s) 530 to drain opening 532.

As illustrated in FIG. 5, drain assembly 506 is assembled to an interior surface of nailing fin 120 of window 104 adjacent, but spaced apart from, the bottom of window 104. An exterior surface of first face 542 is assembled substantially flush with the top surface of frame member 116. In one embodiment, second plate 524 is attached to building paper 112 prior to window 104 being installed in opening 102. In another embodiment, drain assembly 506 is assembled to nailing fin 120 by adhesives or other appropriate means at a distance from the bottom of window 104 equivalent to a height of blocks 121. Once window 104 is installed in opening 102, fasteners 141 are used to secure window 104 within opening 102. Fasteners 141 extend through nailing fin 120, drain assembly 506, building paper 112, sheathing 110 and into frame member 116. In one embodiment, one seal 128 is positioned below fasteners 141 and one seal 128 is positioned above fasteners 141 within drain assembly 506. Flexible sheet 126 extends from within drain assembly 506 to terminate interior of window 104 between block 121 and frame member 116. Moisture that is wicked along flexible sheet 126 is directed downward toward drain opening 532 and out of drain assembly 506. Moisture is transported from drain opening 532 to exterior of the water separation plane 590 of building envelope assembly 100.

Although specific embodiments have been illustrated and described herein, it will be appreciated by those of ordinary skill in the art that a variety of alternate and/or equivalent implementations may be substituted for the specific embodiments shown and described without departing from the scope of the present disclosure. This application is intended to cover any adaptations or variations of the specific embodiments discussed herein. Therefore, it is intended that this invention be limited only by the claims and the equivalents thereof.

What is claimed is:

1. A drain assembly comprising:

first and second plates;

a moisture inlet and a moisture outlet spaced from the moisture inlet; and a flexible sheet disposed between the first and second plates and extending between the moisture inlet and the moisture outlet, the flexible sheet configured to wick moisture;

wherein the drain assembly is formed as an integral piece;

wherein the drain assembly is configured to:

position in an opening in a building envelope assembly;

seal between the moisture inlet and the moisture outlet adjacent the flexible sheet without a separate seal; and transport moisture from the moisture inlet to the moisture outlet to transport moisture from an interior side of an envelope penetrating component positioned within the opening to an exterior side of a water separation plane.

2. The drain assembly of claim 1, wherein the drain assembly is configured to:

vapor seal between the moisture inlet and the moisture outlet adjacent the flexible sheet.

3. The drain assembly of claim 1, wherein the drain assembly is formed of a flexible material.

4. The drain assembly of claim 1, wherein the flexible sheet includes a capillary structure.

* * * * *